United States Patent [19]

Matsuzawa

[11] Patent Number: 5,040,392

[45] Date of Patent: Aug. 20, 1991

[54] CYLINDER LOCK

[76] Inventor: Isamu Matsuzawa, c/o G. S. K. Sales Company, Limited 12-2, Sotokanda 2-Chome, Chiyoda-ku, Tokyo, Japan

[21] Appl. No.: 475,191

[22] Filed: Feb. 5, 1990

[30] Foreign Application Priority Data

Nov. 2, 1989 [JP] Japan ..... 1-286878

[51] Int. Cl.[5] ..... E05B 29/02

[52] U.S. Cl. ..... 70/369; 70/377

[58] Field of Search ..... 70/369, 367, 368, 375, 70/376, 377

[56] References Cited

U.S. PATENT DOCUMENTS

| | | | |
|---|---|---|---|
| 1,990,934 | 2/1935 | Falk | 70/369 |
| 2,000,829 | 5/1935 | Falk | 70/369 |
| 2,059,695 | 11/1936 | Jacobi | 70/369 |
| 2,059,698 | 11/1936 | Jacobi | 70/369 |

*Primary Examiner*—Robert L. Wolfe
*Attorney, Agent, or Firm*—Fred Philpitt

[57] ABSTRACT

A cylinder lock has an external cylinder member and an internal cylinder member inserted in the external member. Further it has an elevatable plate provided with its lower end protruding in a key slot axially formed in the internal cylinder member and a stopper placed on the top arc periphery of the elevatable plate. A key adapted to be used exclusively for exchanging or removing the internal cylinder member is used in a situation that the key is lost and another key having another key code is necessary to use in place of the old key. When the lock is to be opened, the key to be exclusively used to remove the internal cylinder member is inserted into the key slot and the elevatable plate is raised together with the stopper, so that the stopper is disengaged from the internal cylinder member.

6 Claims, 6 Drawing Sheets

CYLINDER LOCK

BACKGROUND OF THE INVENTION

1. Field of the Invention

The present invention relates to a cylinder lock and, more particularly, to a cylinder lock high in safety in various types of fields or applications. It is necessary to use a cylinder lock provided with an internal cylinder capable to be taken out of the mechanism of the cylinder lock when only a key to be exclusively used to exchange the internal cylinder opens or unlocks the cylinder lock, when the lock has to be exchanged by another lock with a different key code due to a missing key or the like, 2. Description of the Prior Art Conventionally, when the key of the cylinder lock is lost, only a spare key has been preferably used in case it is not necessary to exchange the lock. However, in case it is necessary to exchange the lock for some reason following methods have been executed.

- a method for exchanging all the lock
- a method for providing or preparing a lock for a customer and a lock for a manager for a lock device and removing an internal cylinder by the lock for manager
- a method for removing a lock in which an internal cylinder is integrated with an external cylinder in construction from a housing of the rock by the use of an exchanging master key.

Nowadays, there have been many accidents that a key is lost for a lock used in a lending locker for keeping clothes or belongings in golf links, a swimming pool, a fitness club or the like, a post office box, a lending safe, a multiple dwelling house or the like. Accordingly, in order to cope with this situation, a spare key has been frequently prepared.

In view of a crime prevention, however, it is not preferable to use the spare key. Thus, there has been a strong demand to exchange the lock when the key is lost.

When a method for exchanging a whole lock device is employed in order to meet this demand, there has been such a disadvantage as an amateur cannot work, nor cope with this work quickly, which results in producing an uneconomical problem.

The respective methods as set forth above that the lock for the customer and the lock for the manager are provided or prepared and the internal cylinder is removed by the lock for the manager, and that the lock in which the internal cylinder is integrated with the external cylinder is removed from the housing by the use of the exchanging master key are complicated in structure, so that they necessarily cause the cost of all the lock device to be high disadvantageously.

The present invention is proposed in view of these shortcomings and is designed to provide a cylinder lock simple in structure and capable of being produced in large quantities at low cost in which an internal cylinder can be simply taken out and exchanged only under an unlocked condition by means of a key only for exchanging the internal cylinder.

SUMMARY OF THE INVENTION

The present invention, to attain the above mentioned object, provides a novel cylinder lock having an outer or external cylinder and an internal cylinder. The internal cylinder has a key slot extending through the cylinder axially and an elevating body provided at the rear end of the cylinder. The elevating body is applied to the rear end of the cylinder so as to make a lower end of the body projects in the key slot. A stopper or engaging plate is applied to the rear end of the outer or external cylinder so as to be engaged resiliently with an external edge of the internal cylinder in order to lock up the lock. When the lock is to be unlocked, the key for exchanging the internal cylinder is fitted to the lock in order to press the elevating body upwardly. The engagement of the stopper with the internal cylinder is disengaged when the elevating body is raised by a uprising motion of the key.

Operation of the cylinder lock of the present invention will be explained.

When the user of a lock loses a key or the key is stolen and it is required to exchange the lock, an internal cylinder exchanging key is inserted into the key slot of the internal cylinder and rotated by 90 degrees to a direction for unlocking the lock from an locked state and concurrently the internal cylinder is rotated by the same angle.

At this time, the guide part formed at the end of an internal cylinder exchanging key pushes up an elevating body that is, an elevating plate or an elevating pin for disengaging a stopper, in order to remove the stopper which is resiliently held to the internal cylinder side by a spring and engaged in an engaging groove on the periphery of the internal cylinder from the engaging groove of said internal cylinder.

As a result of this operation, the internal cylinder is completely freed from an external cylinder and the internal cylinder is pulled out by drawing out an internal cylinder exchanging key.

Then, an internal cylinder having another key with a different key code is inserted in the external cylinder and reversed to a direction for the locked state of the lock, thereby, an operation for exchanging the internal cylinder is completed.

DESCRIPTION OF THE PREFERRED EMBODIMENTS

Figure 1:
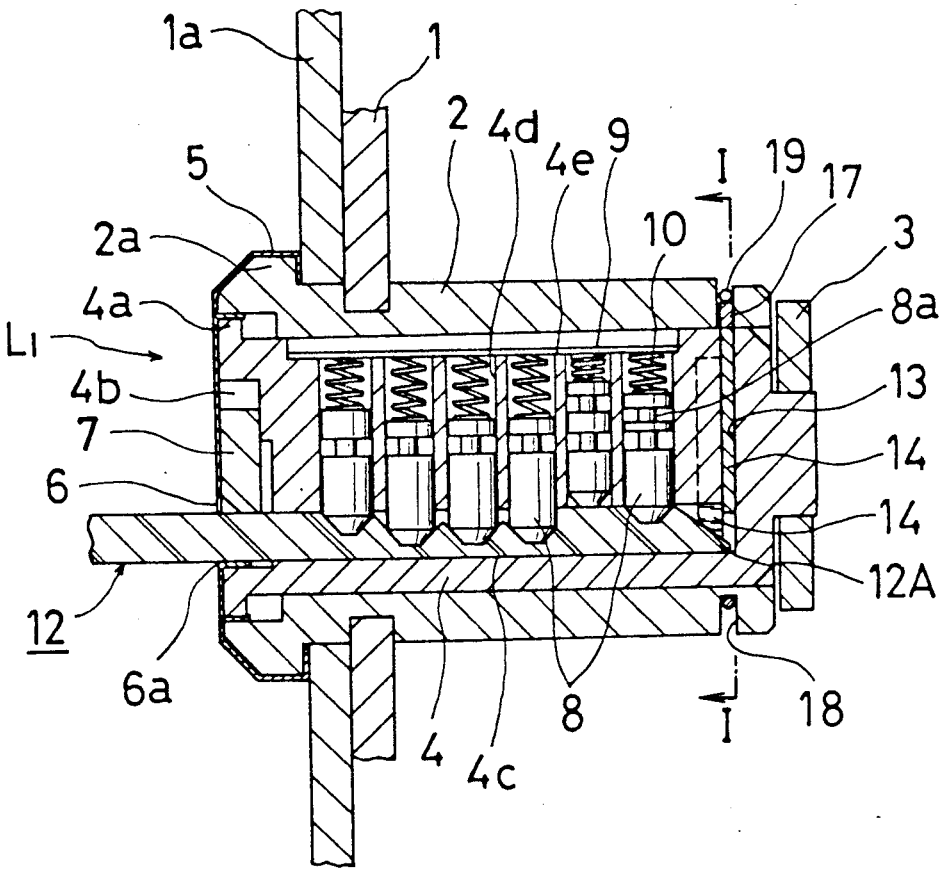
FIG. 1 is a longitudinal section side view showing the unlocked state of an embodiment of the present invention.

Referring now to the drawings, a first embodiment of the present invention will be explained in more detail by way of a pin tumbler type cylinder lock $L_1$.

In FIG. 1, the pin tumbler type cylinder $L_1$ capable of pulling out a key in a locked position is constituted of an external cylinder 2 supported by and fixed to the support plate 1 of a lock case (not shown) and an internal cylinder 4 slidably and rotatably inserted into this external cylinder 2 and angularly fitting a cylinder cam with its back end.

The external cylinder 2 of the cylinder lock $L_1$ has a swollen or enlarged edge 2*a* formed on which a cover 5 is applied on the front face thereof. A reference numeral 1*a* indicates a door plate.

On the front face of the internal cylinder 4 of the cylinder lock $L_1$, a front 4*a* on which a front cover 6 is applied is formed and the front space 4*b* formed in the back side of said front cover 6 has a shutter 7 for closing the key hole 6*a* of the front cover 6, which shutter 7 is inserted or attached to the front space 4*b* so as to be freely opened and shut.

A key slot 4*c* communicating with the key hole 6*a* of said front cover 6 is bored longitudinally in the lower part of said internal cylinder 4. The two rows of a plurality of pin holes 4*d* communicating with said key slot 4*c* in orthogonal positions therewith are bored in a zigzag manner with prescribed intervals between the key slot and the flat seat 4*e* of an upper face. In the respective pin holes 4*d*, cord pins 8 having cord grooves 8*a* on the upper parts thereof are inserted in such a way that they are constantly energized downwardly by a cover plate 9 fixed to said seat 4*e* and coil springs 10.

Figure 4:
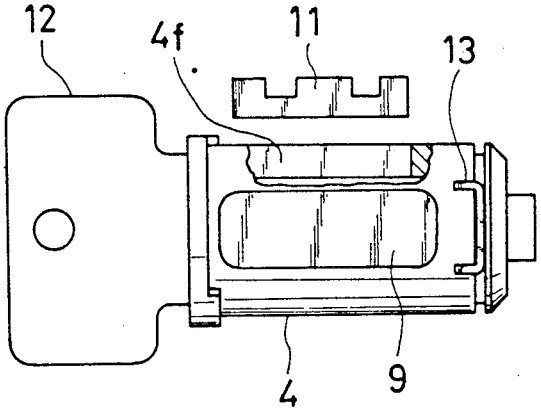
FIG. 4 is a partly broken away exploded plan view of an internal cylinder 4.
Figure 5:
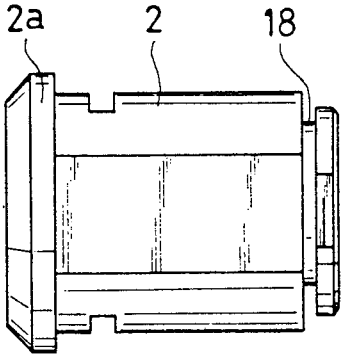
FIG. 5 is a plan view of an external cylinder 2.

In both the side faces of the internal cylinder 4, as shown in FIG. 4, bar slots 4*f* communicating orthogonally with the respective pin holes 4*d* are cut and side bars 11, 11 are idly or loosely fitted into the respective bar slots 4*f*.

The side bars 11 and 11, respectively protrudes from the internal cylinder 4 at the time of locking and are engaged with the recessed parts (not shown) of the inner wall of the external cylinder 2. When a key 12 is inserted into the key slot 4*c* of the internal cylinder 4 from the key hole 6*a* of the front cover 6 and the respective cord pins 8 are pushed up to prescribed positions by its indents 12*a*, the cord grooves 8*a* are aligned in a straight line, the base parts of the side bars 11, 11 are moved back and inserted into the respective cord grooves 8*a* and the end parts thereof are simultaneously retracted to the bar slots 4*f*, thereby, the engagement with the external cylinder 2 is released.

Consequently, the internal cylinder can be made to rotate and the lock is unlocked by rotating the key 12 to 90 degrees.

The foregoing description concerns the fundamental constitution of the pin tumbler type cylinder lock $L_1$. An internal cylinder exchanging mechanism which is the main part of the present invention will be explained hereinafter.

On the upper face of the back end of the internal cylinder 4, the slit 13 communicating orthogonally with the interior end of the lower key slot 4*c* formed in parallel to the cord pins 8 and having the section of ] shape is bored. In said slit 13, an elevating body pressed and pushed up by a diagonally cut guide part 12*b* at the end of a key 12A for exchanging the internal cylinder, that is, an elevating plate 14 is loaded. On the periphery of the internal cylinder 4 on the extension of said slit 13 is cut a circular arc shaped engaging groove 15 engaged by the stopper of the external cylinder 2, which will be described below, at the time of locking.

Figure 6:
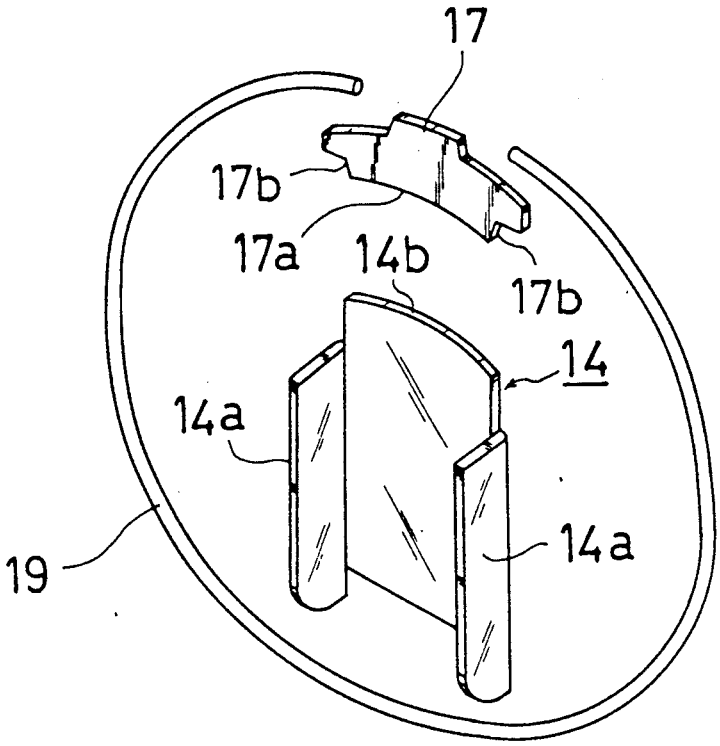
FIG. 6 is an exploded perspective view of main parts of the present invention.

Said elevating plate 14, as shown in FIG. 6, has both sides bent forward at right angles with a base plate of the elevating plate 14 so as to form protrusions 14*a*, 14*a* protruding with their ends rounded in such a way that the elevating plate 14 is smoothly pushed up and elevated when it is pressed by the guide part 12*b* at the end of the key 12A for exclusively exchanging the internal key which is inserted into the key slot 4*c*. The elevating plate 14 additionally has an upper side part having a circular arc edge 14*b* of the same configuration as the periphery of the internal cylinder 4 which is formed on the top of the elevating plate 14.

In the part of the external cylinder 2 opposite to the slit 13 and the engaging groove 15 of said internal cylinder 4, a pair of slits 16 slightly large in width which communicates with said slit 13 and the engaging groove 15 is bored and in said slit 16, a stopper that is, an engaging plate 17 for preventing the internal cylinder 4 from being pulled out, is applied so as to be freely elevated.

On the extensions of said slits 16 and 16, a circular arc shape spring groove 18 is cut in the periphery of the external cylinder 2 and a cut out ring shape spring 19 is fitted in said spring groove 18 as a resiliently pressing member for resiliently pressing and holding both the ends of the upper face of said engaging plate 17.

As illustrated in FIG. 6, said engaging plate 17 has a circular arc edge 17*a* formed so as to have the same configuration as the inner periphery of the external cylinder 2 (the same configuration as the outer periphery of the internal cylinder 4 and the upper circular arc edge 14*b* of the elevating plate 14*b*) and notches 17*b*, 17*b* engaging with the upper edges of the slits 16 of the external cylinder 2 at the time of locking which notches are respectively formed at the lower parts of both the sides of the elevating plate 17.

Figure 3:
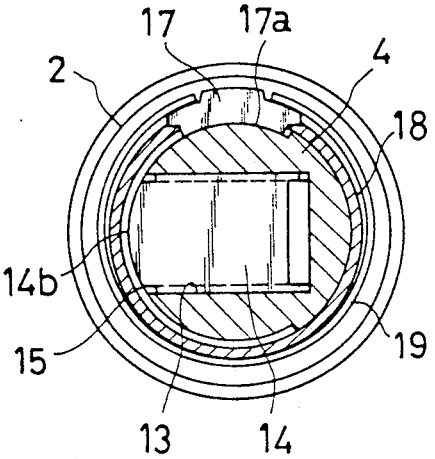
FIG. 3 is a sectional view showing the locked state of the above embodiment.

The elevating plate 17 takes such a position as shown in FIG. 3, at the time of locking. Namely, the lower circular arc edge 17*a* is engaged in the engaging groove 15 of the internal cylinder 4 and both the side notches 17*b*, 17*b* are engaged with the upper edges of the slits 16 of the external cylinder 2 and the elevating plate 17 is situated at a position rotated by 90 degrees from the elevating plate 14 positioned in the slit 13 of the internal cylinder 4.

Figure 2:
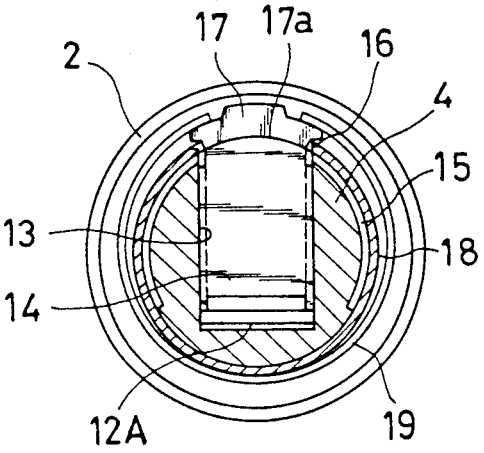
FIG. 2 is a sectional view taken along a line I—I of FIG. 1.

When it is required to exchange the internal cylinder 4 due to the loss of the key or the like, the key 12A for exchanging the internal cylinder is inserted into the key slot 4*c* as shown in FIG. 2, rotated by 90 degrees and returned to an unlocking position. Then, the guide part 12*b* at the end of the key 12 for exchanging the internal cylinder abuts against the protrusions 14*a*, 14*a* at the lower portions of the elevating plate 14 and pushed up and elevates the elevating plate 14. At this time, since the slit 13 of the internal cylinder 4 communicates with the slit 16 of the external cylinder 2, the engaging plate 17 is also pushed up as the elevating plate 14 is elevated.

As a result of this action, the lower circular arc edge 17*a* of the engaging plate 17 is disengaged from the engaging groove 15 of the internal cylinder 4, so that the internal cylinder 4 is completely freed from the external cylinder 2 and it can be pulled out therefrom.

Figure 7:
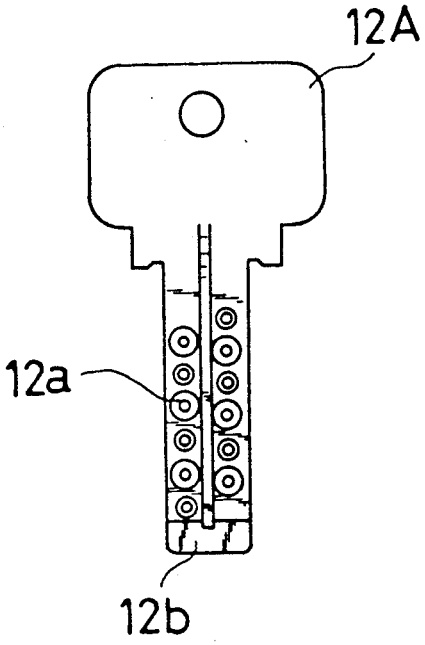
FIG. 7 is a plan view of a key 12A for exchanging the internal cylinder.
Figure 8:
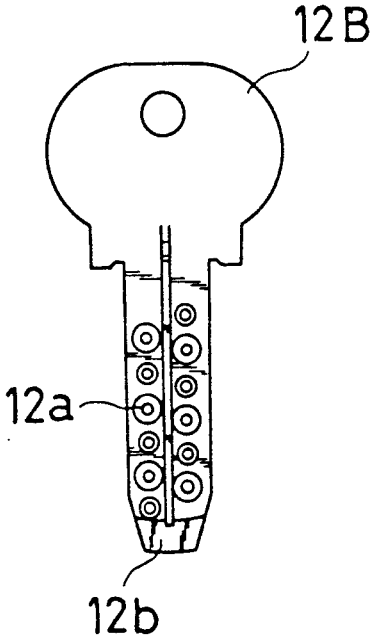
FIG. 8 is a plan view of a locking and unlocking key 12B.

Said key 12A for exchanging the internal cylinder is formed as a flat plate as shown in FIG. 7, has hole shape indents 12*a* similar to those of a locking and unlocking key 12B (ordinary master key) shown in FIG. 8 and a guide part 12*b* at its front end which is formed to an angular form so as to abut against the protrusions 14*a*, 14*a* at both the sides of the lower portions of the elevating plate 14. The guide part 12*b* at the end of the locking and unlocking key 12B (including a master key) of the original cylinder lock $L_1$ is cut out to a trapezoid shape or a circular arc shape in the part which abuts against the protrusions 14*a*, 14*a*, as shown in FIG. 8, thus, the elevating plate 14 cannot be pushed up.

The configuration of the keys 12A, 12B should not be limited to those mentioned above but, for instance, the two types of long and short keys may be prepared, the short one may be used as the ordinary locking and unlocking key 12B and the other one may be used as the key 12A for exchanging the internal cylinder.

A second embodiment of the present invention will be now explained in detail by way of a disk tumbler type cylinder lock $L_2$.

Figure 9:
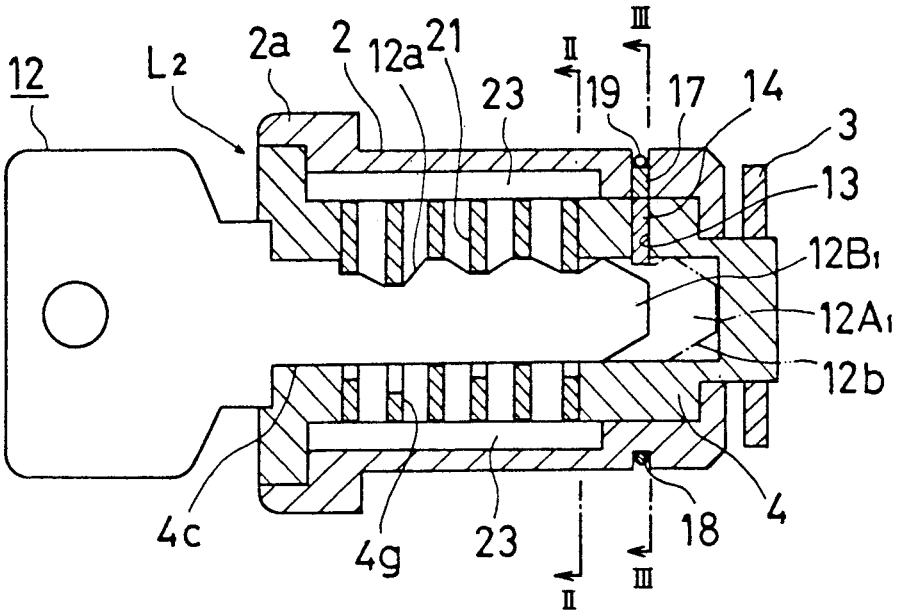
FIG. 9 is a longitudinally sectional side view showing the unlocked state of a second embodiment of the present invention.
Figure 10:
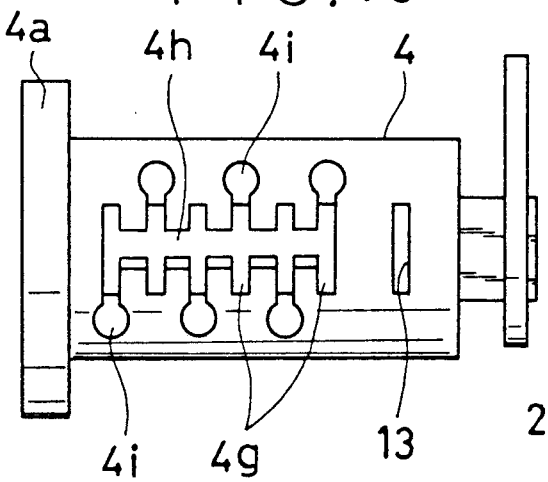
FIG. 10 is a plan view of the internal cylinder 4.
Figure 11:
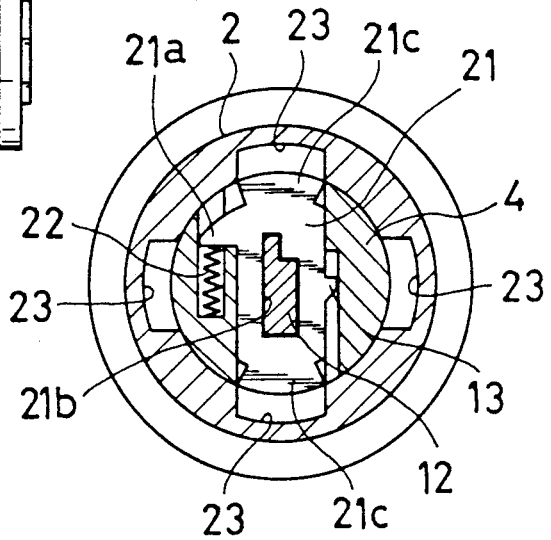
FIG. 11 is a sectional view taken along a line II—II of FIG. 9.

With reference to FIG. 9, the disk tumbler type cylinder lock $L_2$ in which a key in a locked position can be pulled out is constituted of an external cylinder 2 and an internal cylinder 4 inserted into this external cylinder 2 similarly to the first embodiment of the present invention.

At the end parts of the external cylinder 2 and the internal cylinder 4, mutually engaging swollen or enlarged edges 2*a*, 4*a* are respectively formed.

In the center part of said internal cylinder 4, a key slot 4*c* is opened and the prescribed number (six holes in this embodiment) or a plurality of disk inserting holes 4*g* communicating orthogonally with said key slot 4*c* are provided in a longitudinal direction.

These disk inserting holes 4*g* are opened at their upper parts and respectively communicated by a longitudinal groove 4*h* at the center of the internal cylinder 4. Further, in the outside parts of the respective disk inserting holes 4*g*, spring holes 4*i* are bored in an alternate and zigzag manner.

In each disk inserting hole 4*g*, a disk 21 with a spring receiver 21*a* at its side is inserted and the disk 21 is constantly energized upward by a spring 22 inserted into said spring hole 4*i*.

It is apparent that each disk 21 has an angular shape key hole 21*b* opened into which a key 12 is inserted and protruding pieces 21 adapted to be engaged with and disengaged from four notches 23 formed at the intervals of 90 degrees on the inner periphery of the external cylinder 2 which are provided at the upper and the lower parts of the disk.

The protruding pieces 21*c* protrude from the internal cylinder 4 and are engaged with the notches 23 of the external cylinder 2 at the time of locking. However, when the key 12 is inserted into the key slot 4*c* of the internal cylinder 12 and the key holes 21*b* of the disks 21 and the respective disks 21 are pressed down by its indents 12*a*, the protruding pieces 21*c* of the disks are forcedly pulled down or retracted to the respective disk inserting holes 4*g* of the internal cylinder 4 against the spring force of the springs 22. As a result, the engagement with the notches 23 cut in the inner periphery of the external cylinder 2 is released.

As a result of this operation, the internal cylinder 4 can be rotated and unlocked by rotating the key 12 by 90 degrees.

The foregoing description concerns the fundamental constitution of the disk tumbler type cylinder lock $L_2$. An internal cylinder exchanging mechanism which is the main part of the present invention will be explained hereinafter.

On the upper face of the back end of the internal cylinder 4, a slit 13 communicating orthogonally with the interior end of the key slot 4*c* in the center of the internal cylinder and in parallel with the disk inserting holes 4*g* is bored. In said slit 13 is inserted an elevating body or an elevating plate 14 which is pressed and pushed up by a diagonally cut guide part 12*b* formed at the end of a key $12A_1$ for exchanging the internal cylinder.

On the outer periphery of the internal cylinder 4 on the extension of said slit 13, is cut a circular arc shape engaging groove 15 with which the stopper of the external cylinder 2 is engaged at the time of locking as explained hereinafter.

Figure 12:
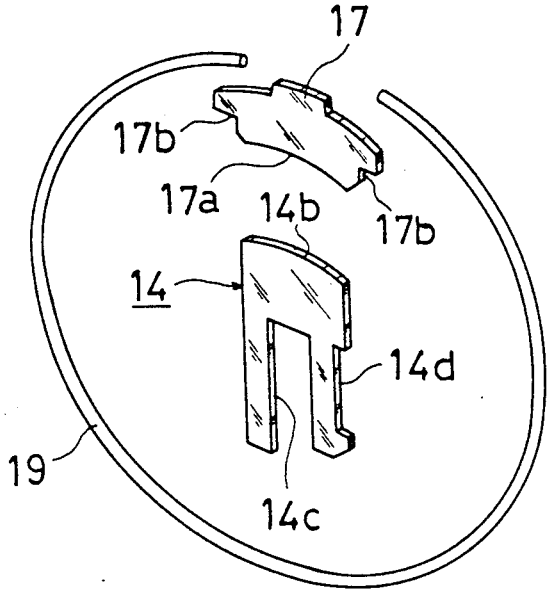
FIG. 12 is an exploded perspective view of main parts of the invention.
Figure 13:
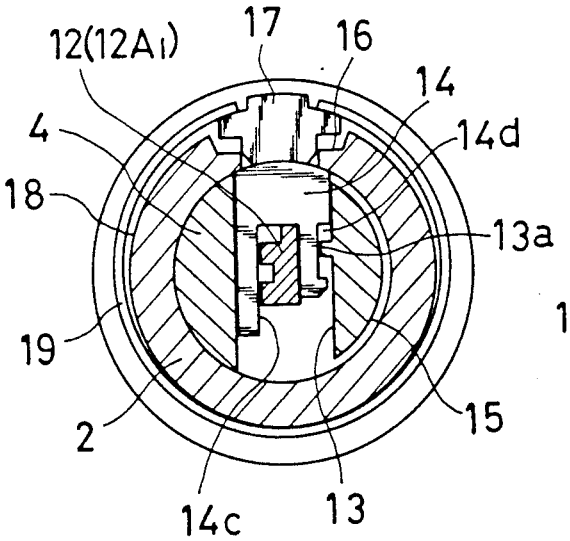
FIG. 13 is a sectional view taken along a line III—III of FIG. 9.
Figure 14:
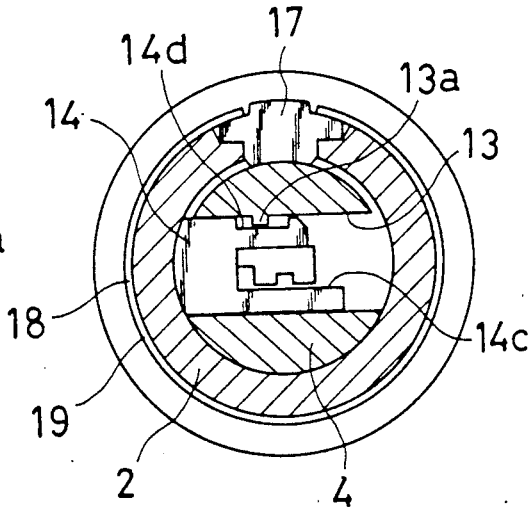
FIG. 14 is a sectional view showing the locked state of the second embodiment.

Said elevating plate 14, as shown in FIGS. 12, 13, has a key way 14*c* at the opening of a lower part communicating with the key holes 21*b* of said disks 21 into which the key 12 is inserted, a circular arc or curve edge 14*b* of the same configuration as the outer periphery of the internal cylinder 4 which formed at the upper side part thereof and a cut out step part 14*d* pressed to and engaged with a protrusion 13*a* disposed in said slit 13 at the side of the elevating plate.

On a position in the external cylinder 2 opposite to said slit 13 and the engaging groove 15 is bored a slit 16 communicating with said slit 13 and said engaging groove 15 and in said slit 16 is inserted a stopper or freely elevatable for preventing the internal cylinder 4 from being pulled out, an engaging plate 17.

On the outer periphery of the external cylinder 2 in the extensions of said slit 16 is cut a spring groove 18. In said spring groove 18 is fitted a cut out ring shape spring 19 as a resiliently pressing member for resiliently pressing both the ends of the upper face of said engaging plate 17 and holding the plate.

Said engaging plate 17 has the same structure as that of the embodiment 1. An operation for exchanging the internal cylinder 4 due to the loss of the key 12 or the like is also similar to that of the embodiment 1 above.

Figure 18:
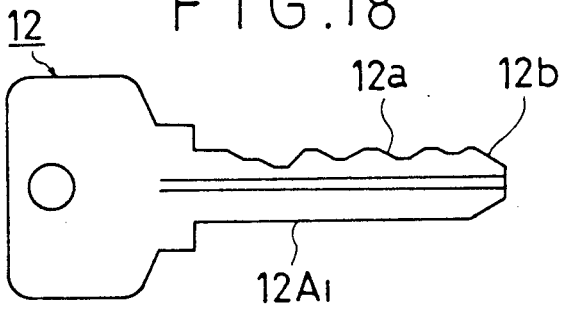
FIG. 18 is a plan view of a key $12A_1$ for exchanging the internal cylinder and FIG. 19 is a plan view of a locking and unlocking key $12B_1$.
Figure 19:
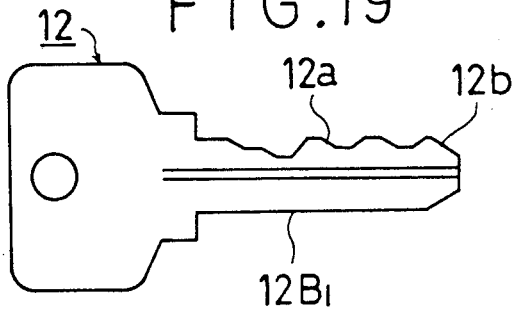

As the key 12 of this second embodiment, the two types of long and short keys are prepared as shown in FIGS. 18 and 19. A locking and unlocking key $12B_1$ (ordinary master key) has such a length that it does not abut against the elevating plate 14 when it is inserted into the key slot 4*c*. On the other hand, a key $12A_1$ for exchanging the internal cylinder has such a length that the guide part 12*b* at the front end can press the elevating plate 17.

Figure 15:
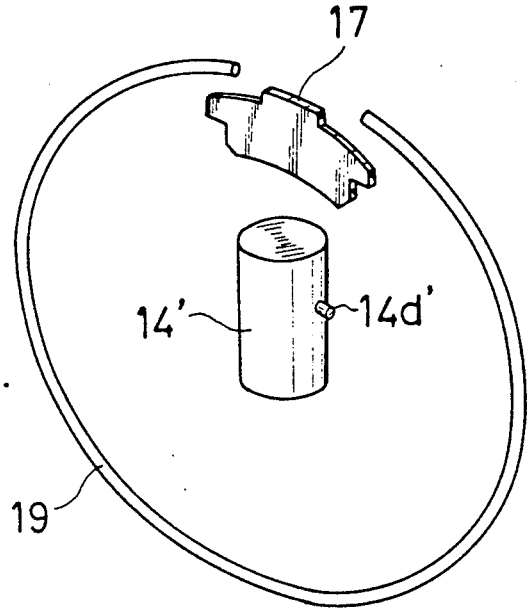
FIGS. 15 to 17 are perspective views showing another forms of the main parts of the invention.
Figure 16:
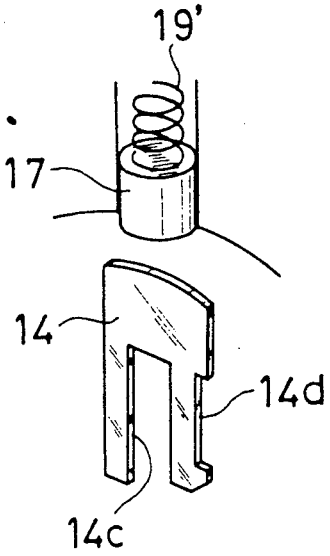
Figure 17:
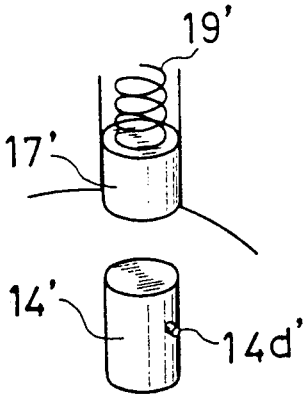

With reference to FIGS. 15 to 17, another embodiment of the internal cylinder exchanging mechanism which is the main part of the invention will be now explained as follows.

In the respective cylinder locks $L_1$, $L_2$ of the pin tumbler type or the disk tumbler type, it is possible to use, the elevating plate thereof, not only the elevating plate 14 but also an elevating pin 14' with a protrusion **14*d'* on the side face as shown in FIG. 15**.

As the stopper, not only the engaging plate 17 but also an engaging pin 17' may be employed as illustrated in FIG. 16.

In this case, as shown in FIG. 17, the engaging pin 17' may be combined with the elevating pin 14' in place of using the elevating plate 14.

Furthermore, as the resiliently pressing member for resiliently pressing and holding said engaging pin 17', not only the cut out ring shape spring 19 but also a coil spring 19' may be employed as shown in FIGS. 16, 17.

As set forth above, the cylinder lock of the present invention is constituted of an internal cylinder 4 and an external cylinder 2 and a key slot **4*c* bore in the internal cylinder wherein a slit 13 communicating orthogonally with the interior end of the key slot 4*c* is bored at the back end of the internal cylinder 4, an elevating plate 14 or an elevating pin 14' pressed and pushed up by the end of a key 12A for exchanging the internal key is inserted therein, an engaging groove 15 is cut on the outer periphery of the internal cylinder 4 in the extension of said slit 13, a slit 16 is cut communicating with the slit 13 of the internal cylinder 4 in said external cylinder 2 and an engaging plate or an engaging pin 17' is loaded or inserted therein. It is resiliently engaged with the engaging groove 15 of the internal cylinder 4 at the time of locking to prevent the internal cylinder 4 from being pulled out from the external cylinder 2 and pressed and pushed up by the elevating plate 14 or the like at the time of unlocking so as to release the engagement with the engaging groove 15 against a spring force and permit the internal cylinder 4 to be pulled out from the external cylinder 2. Accordingly, when it is required to exchange the internal cylinder 4 due to the loss of a key 12 or the like, a key 12A only for exchanging the internal cylinder 4, completely different from an ordinary locking and unlocking key 12B may be inserted into the key slot 4*c*, rotates to an unlocking position and then the internal cylinder 4 can be pulled out, so that even an amateur can simply and rapidly exchange the internal cylinder. A cost for fabrication of the cylinder lock of the present invention is low, a difficulty encountered in the operation is reduced, and additionally, since the internal cylinder 4** cannot be pulled out under the locked position, as mentioned above, so that safety is extremely high.

What is claimed is:

1. A cylinder lock comprising in combination (a) an external cylinder (2), (b) an internal cylinder (4) located concentrically within said external cylinder (2), and containing means to engage a key, (c) a key slot (**4*c*) extending in a longitudinal direction through said internal cylinder (4), (d) means for alternately locking and unlocking said external cylinder (2) and said internal cylinder (4) against longitudinal movement relative to each other comprising (i) a first member (14) slidably mounted in a first slot (13, 15) located adjacent the back end of said internal cylinder (4), said first slot (13, 15) being perpendicular to the axis of said internal cylinder (4) and having a lower end opening into said key slot (4*c*) so that it can be contacted and moved upwardly in said first slot (13, 15) when the end of a long key is fully inserted into said key slot (4*c*), and (ii) a second member (17) slidably mounted in a second slot (16) located adjacent the back end of said external cylinder (2), said second slot (16), being opposite said first slot (13, 15) and (16) being perpendicular to the axis of said external cylinder (2), the lower portion of said second member (17) being urged into a slot or cavity in the exterior portion of said internal cylinder (4) and into contact with the upper surface (14*b*) of said first member (14) by resilient biasing means (19, 19'), whereby when no key is in said key slot (4*c*) said external cylinder (2) and said internal cylinder (4) will be locked together so as to prevent longitudinal movement relative to each other, but when a long key is fully inserted in said key slot (4*c*), the inner end (12*b*) of the key will force both said first member (14) and said second member (17) away from said key slot (4*c*) until the lower portion of said second member (17) no longer extends within a slot or cavity in the exterior portion of said internal cylinder (4) thus permitting longitudinal disengagement of said internal cylinder (4) from said external cylinder (2**).

2. A cylinder lock according to claim 1 wherein said first member (14) is in the form of a U-shaped plate.

3. A cylinder lock according to claim 2 wherein said second member (17) is in the form of a plate.

4. A cylinder lock according to claim 1 wherein said second member 17 is a pin.

5. A cylinder lock according to claim 1 wherein said resilient biasing means (19') is a coil spring.

6. A cylinder lock according to claim 1 wherein said resilient biasing means (19) is a ring-shaped spring.

* * * * *